US006508698B1

(12) United States Patent
Faas

(10) Patent No.: US 6,508,698 B1
(45) Date of Patent: Jan. 21, 2003

(54) GRINDING OR CLEANING DEVICE FOR A TEXTILE MACHINE

(75) Inventor: Jürg Faas, Andelfingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 91 days.

(21) Appl. No.: 09/664,803

(22) Filed: Sep. 19, 2000

(30) Foreign Application Priority Data

Oct. 11, 1999 (DE) ..... 199 48 996

(51) Int. Cl.[7] ..... B24D 11/00
(52) U.S. Cl. ..... 451/526; 451/416
(58) Field of Search ..... 451/416, 417, 451/184, 526, 527, 166, 167, 490, 496, 534

(56) References Cited

U.S. PATENT DOCUMENTS 1,507,836 A * 9/1924 King ..... 451/542
3,918,220 A * 11/1975 Jury et al. ..... 451/59
4,504,283 A * 3/1985 Charvat ..... 51/298
4,945,687 A * 8/1990 Scheider et al. ..... 451/532
5,187,904 A * 2/1993 Tyler et al. ..... 451/463
5,989,110 A * 11/1999 Leifeld ..... 451/416
6,024,634 A * 2/2000 Koglund et al. ..... 451/532
6,129,614 A * 10/2000 Faas et al. ..... 451/184
6,152,814 A * 11/2000 Amarosa, Sr. et al. ..... 451/526

FOREIGN PATENT DOCUMENTS

DE 19739187 3/1999

* cited by examiner

*Primary Examiner*—Joseph J. Hail, III
*Assistant Examiner*—David B. Thomas
(74) *Attorney, Agent, or Firm*—Dority & Manning

(57) ABSTRACT

A device for grinding clothing teeth and wire, or for cleaning cylinders, in a textile machine includes a grinding part having an elastic layer and grinding elements embedded throughout the elastic layer. The elastic layer is formed into a shape for being pressed against the clothing teeth, wire, or cylinder of the textile machine, and is formed of a material such that the elastic layer is worn by the clothing teeth, wire, or cylinder. In this way, the underlying embedded grinding elements are exposed.

18 Claims, 4 Drawing Sheets

GRINDING OR CLEANING DEVICE FOR A TEXTILE MACHINE

Figure 1:
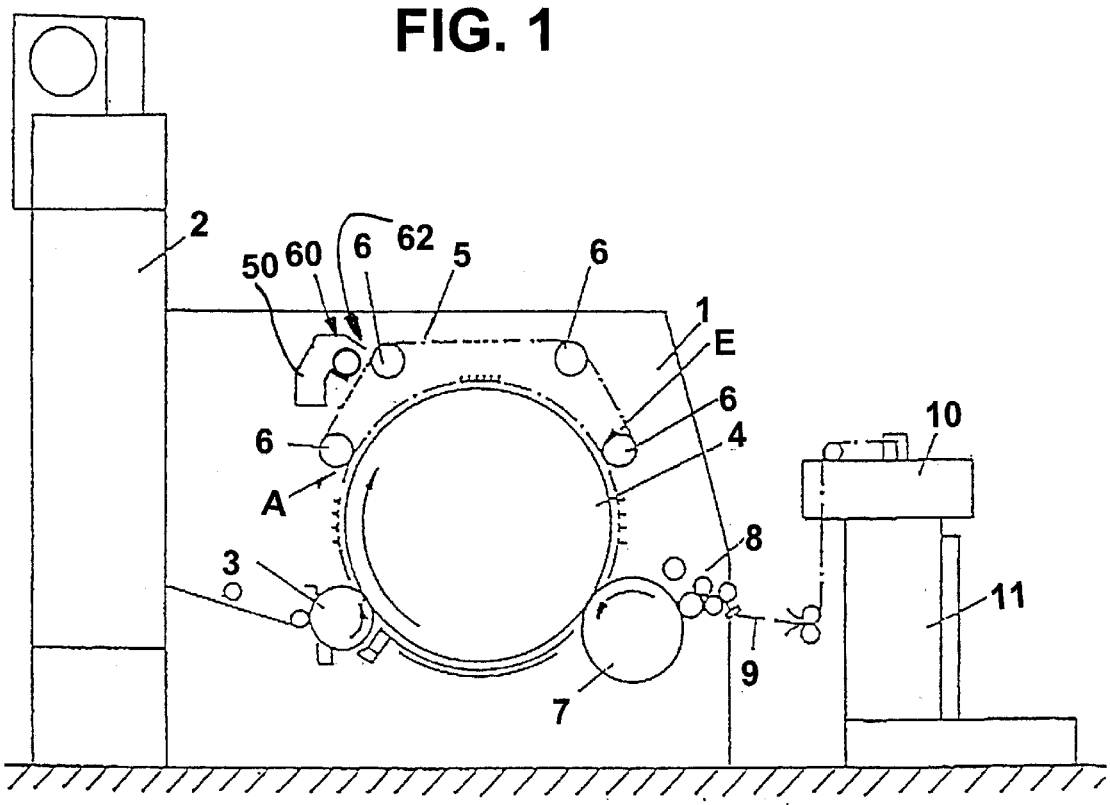

The present invention relates to a device to grind clothing teeth or wires or to clean cylinders in particular in cards with a grinding part with an elastic layer.

From the DE 197 38 187 A1 a device on a card is known, at which the cover surface of a grinding roller is elastic and which engages with slight pressure with the points of the flat clothing. With this, without setting high requirements for the grinding means and its carrier means, an even grinding of the points of the flat clothing is to be maintained. The structure of the roller at said known art is such, in that on a soft-elastic cover of for instance foam material as padding a further cover layer with a grinding material, for instance grinding grains of corundum is being attached. Thereby the cover layer is a carrier consisting of textile material, which is being wound over an inner cover. The textile-type carrier for the grinding means is elastic at least in one direction of the applied fabric or knit material. The weight of the roller itself generates a pressing force by which the roller rests on the clothing.

Thus according to the DE 197 39 187 a hard but flexible outer layer is being provided on a soft-elastic base. By means of the elastic layer according to the known art the grinding means is to adapt itself 'to the deviations in relation to different heights of the points'. Thereby 'single protruding clothing points are to be able to penetrated deeper into the surface and become thereby deformed in such a way, that also the less protruding points come in contact with the grinding surface'. Thus it is not intended that the single points can penetrate the harder grinding layer. The wear behaviour of this grinding layer is not being described in DE 197 38 187.

In a device according to the known art problems are encountered to meet the requirement of accuracy for the manufacturing of the grinding roller. It is hereby reminded that the roller is of an axial length of at least one meter, whereat during grinding of a clothing only fractions of millimeters of the wire element may be removed. According to the known art the surface of the roller is surposed to be hard and flexible at the same time, whereat it is being fastened onto an elastic base. It is practically impossible to form such a surface without having to take into account certain inaccuracies. The transposition of such inaccuracies onto the clothing would be followed by severe consequences for the carding process. The roller manufacturing process according to DE 197 39 187 would thus have to be devised in a complicated manner in order to minimise the expected inaccuracies. Special requirements are being made necessary for elastic cover as well as for the cover layer. Especially the cover layer needs to be produced of a specific yarn, in order to meet the requirements being set for the layer. Beyond that, damage on the cover layer destroys the entire roller.

Thus the object of the invention is to provide a device which eliminates the above disadvantages and which at the same time allows a structurally simple, however, still precise treatment of a clothing or a roller.

The task is being solved with a device with the characteristic features of the patent claim 1. According to the invention the device for grinding of clothing teeth or wires or for cleaning of cylinders comprises a grinding part with an elastic surface. Thereby the grinding part consists of an elastic layer within which the grinding means are being embedded. Herewith the clothing is being ground. On the other hand, however, the elastic layer and the grinding means are also gradually being torn out from the grinding part. Even though this causes a corresponding wear of the grinding part, however, an always sharp grinding part is being brought into contact with the clothing teeth and thus a very effective grinding performance results. The elastic layer can for instance consist of foam material or fleece material.

During grinding the elastic layer itself is thus exposed to the clothing points. The hardness of this layer in relation to the hardness of the clothing elements can be chosen in such a way, that the wear on the rollers is considerably faster than the wear on the clothing points, for instance five times, preferably ten times faster. Embedding of grinding means within the wearable layer thus ensures that the grinding effect can be maintained over a predetermined time. The inevitable inaccuracies in the formation of the outer layer are not being transmitted to the clothing, but the cover surface of the clothing is rather being pressed onto the surface of the roller. The relatively soft carrier material is being worn off by the contact with the clothing points for a period of time until these points get into contact with the grinding particles being embedded within the carrier material.

The elastic layer is being arranged on a rigid carrier, which is adjustable towards the clothing or the cylinders. The carrier can either be a metal plate or a metal cylinder or it can consist of another hard material, for instance fibre reinforced plastic. The carrier can also be formed in such a way, for instance with ribs, that it is extremely stiff and thus deflection is being prevented during grinding or cleaning. The elastic layer can be applied around the carrier by spray coating, casting, gluing or clamping. It forms the holding means for the single grinding means. As grinding means grindstones may be used, for instance corundum grains or also fibres which have a high resistance towards the clothing teeth or wires. For the cleaning of cylinders less aggressive grinding means may be applied so that the cylinders are not being damaged.

Depending on the type of application different shapes of the grinding parts are preferable. It is thus possible that the grinding part consists of a roller, which moves in or against the circumferential direction of the clothing or of the cylinders to be cleaned. Often a respective relative velocity in relation to the clothing and to the cylinders is of advantage in order to affect a grinding or cleaning.

For some applications it is also of advantage if the grinding part consists of a grindstone. The grindstone is either placed onto the surface of the clothing or the cylinders or it is moved back and forth in axial direction of the clothing or the cylinder. Thereby a grinding effect or cleaning effect respectively results on the clothing or the cylinder.

If the elastic layer consists of a wear material, then the grinding means is gradually torn out of the elastic layer and the elastic layer is also gradually being worn off. Thereby in a particular advantageous way and in the sense of the invention, the grinding means, as soon as they have lost their sharpness, are being removed together with the elastic layer and thus new sharp grinding means are exposed. The elastic layer is thus gradually removed and the diameter of the grinding roller or the height of the grindstone respectively is thereby being reduced continuously. The position adjustment of the grinding part is effected by means of a flexible support through which the grinding part, for instance through its own weight, rests on the clothing or the cylinder. The position of the grinding part may also be adjusted towards the clothing or cylinder, either specifically by means of an additional device or by a weight, whose load is for instance adjustable by means of a lever. In the case of clothing wires on flat bars the grinding part can also be supported fixedly and the flat bar can be pressed against the grinding part by means of spring load.

Preferably the elastic layer encloses the grinding part entirely. Thereby during its rotation the grinding roller will always stay in contact with the clothing or the cylinder and thus achieve a high grinding effect. If the grinding part is a grindstone then it can be used several times by turning it by 90°.

If the elastic layer on the grinding part is being arranged in the form of segments, then in an advantageous way, an additional cleaning effect of the grinding part will result. The ground off particles of the grinding part as well as of the clothing or the cylinder are being released due to this segmented arrangement of the elastic layer when they reach the end of a segment and thus do not lead to a soiled grinding part. Moreover a different grinding effect on the grinding teeth or wires results, in particular, if the elastic layer in the various segments comprises different thicknesses.

In a specific embodiment of the invention it is of advantage if the elastic layer contains different grinding means. Said different grinding means can either be arranged evenly within the elastic layer or they may be arranged in sorted manner within the segments. Said segments can either be distributed over the longitudinal axis, the circumference or the height of the elastic layer. Thereby special grinding effects are being achieved, for instance in such a way, that the grinding means, which are arranged nearer to the carrier, are coarser and thus provide a certain compensation for the reduced weight of the grinding part. The elastic layer can also be provided with different thicknesses and/or grinding means with respect to its distribution over the operating width. Herewith a specific grinding effect is being reached, for instance in such a way in that specific levels can be adjusted with regard to the clothing points and other levels with regard to the clothing flanks.

The force by which the grinding part presses onto the clothing teeth or wires or onto the cylinder, can be made adjustable in a particular advantageous embodiment of the device. This is for instance realised with a device for a controlled pressure application. A particularly simple embodiment of an adjustable force can be provided in the form of a weight on a lever arm in relation to the grinding part. By changing the length of the lever, the weight can actuate different pressure forces of the grinding part on the clothing or the cylinders.

Preferably the elastic layer is being made up in such a manner that the clothing teeth or wires at least partially penetrate into the elastic layer. Thereby a particular advantageous grinding effect onto the clothing is being achieved, since through this penetration not only the clothing points but perhaps also the flanks are being effected by the grinding meas and thus also being treated. By this a very advantageous form of the ground tooth or wire results, which during further application of the clothing achieves very good carding results.

In particular if the elastic layer is made as a wear layer, it is of advantage, if a suction means is being attached to the device. Thereby the suction means prevents the ground off material from the clothing or from the cylinders to be cleaned, from falling uncontrolled into the machine.

Further advantages of the invention are being disclosed in the following description of the figures, wherein show:

FIG. 1 a card on which the invention is being applied

Figure 7:
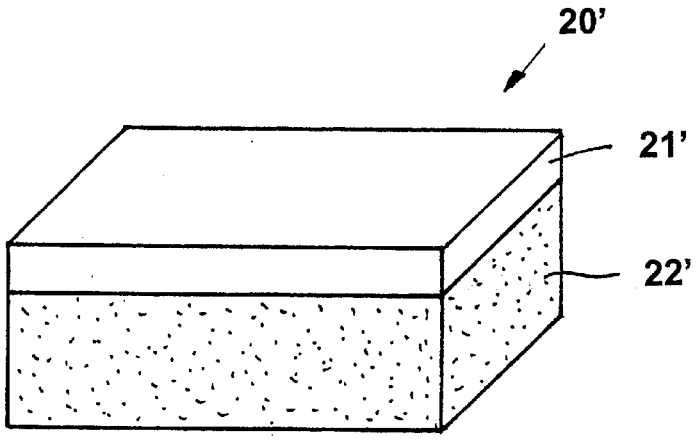
Figure 8:
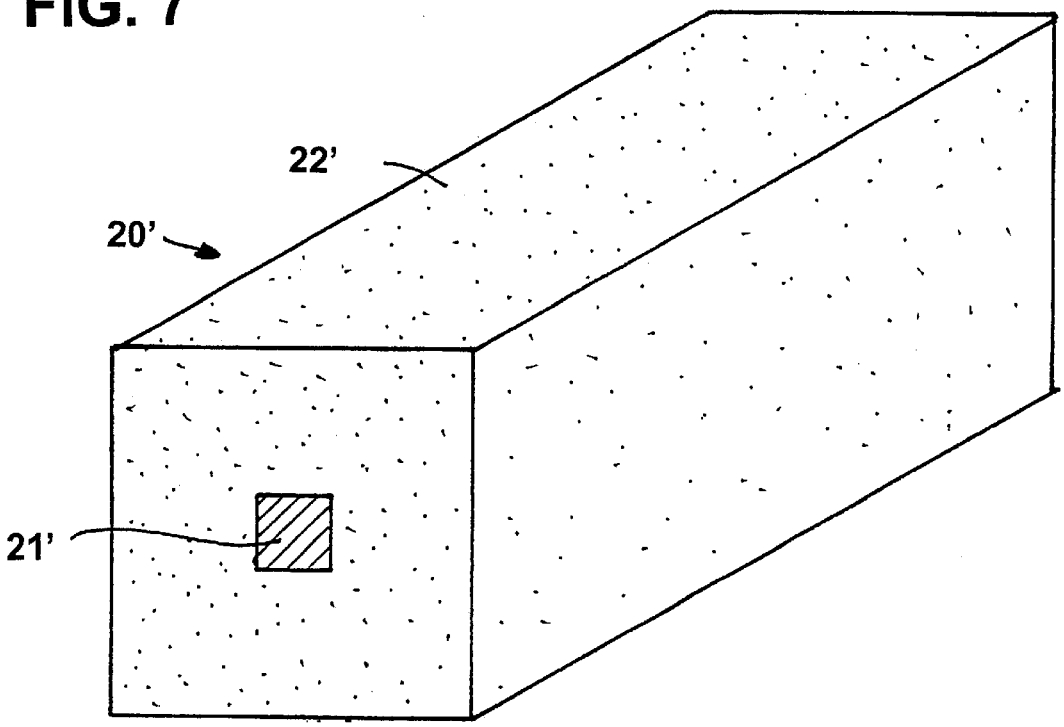
Figure 9:
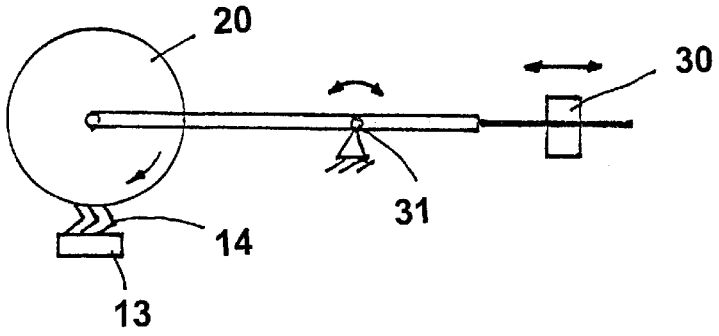

FIGS. 2 to 8 each a respective form of an embodiment of a grinding or cleaning device FIG. 9 a pressure application device.

FIG. 1 schematically shows a known revolving flat card 1, for instance the card C50 produced by the applicant. The fibre material is being fed into the feeding chute 2 in the form of lose and cleaned flocks, then it is being received as cotton lap by a licker-in or taker-in device 3, furthermore it is being transferred to a cylinder or drum 4 and loosened and cleaned by a revolving flat unit. Fibres from the fibre web being formed on the drum 4 are then received by a doffer 7 and being transformed into a sliver 9 within an outlet arrangement 8 comprising various rollers. This card sliver 9 is then, by means of a can coiler 10, being deposited into a can 11 for transportation. The card is being provided with suction means 50, which is indicated schematically, and by which waste can be removed from the grinding position 62. The revolving flat unit comprises the revolving flat bars, which are not shown individually in FIG. 1, however, being indicated with the reference numerals 13 in FIG. 9. Each bar 13 is being furnished with a card clothing 14.

The flats 13 are fastened onto a chain or belt 5 and are thus moved within a closed 'flat path' via deviating rollers 6 in the opposite direction or in the same direction of the turning direction along the cylinder 4, whereat on a 'forward path' from the inlet point E to the outlet point A the carding work is being performed and on the 'return path' the flats are being cleaned at a cleaning station 60. At the position 62 the flats 13 can for instance be ground.

Figure 2:
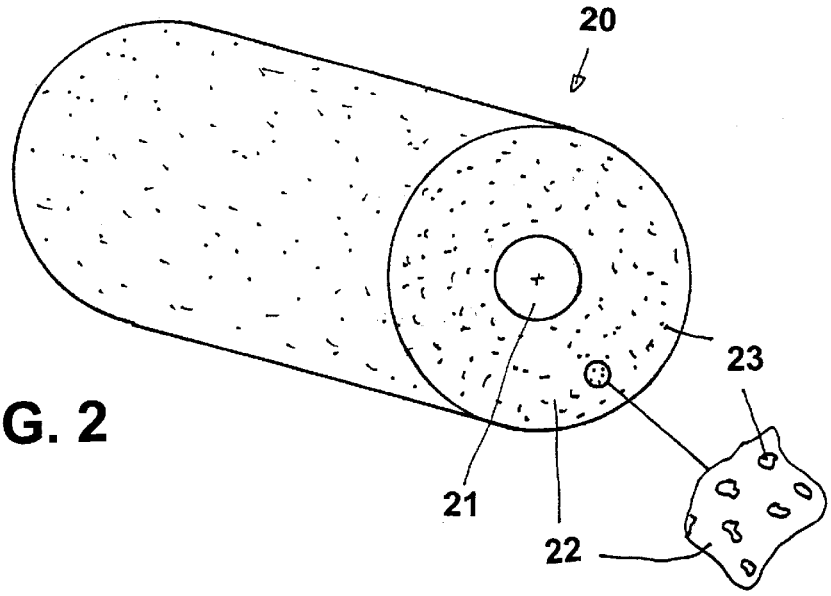

FIG. 2 shows a grinding part 20 in the form of a roller. The grinding part 20 comprises a carrier 21 which can be supported rotatably. Beyond that by rotating the carrier 21 or the grinding part 20 respectively, a relative speed in relation to the clothing to be ground or to the cylinder to be cleaned results and thus a good grinding or cleaning effect respectively is achieved.

The grinding part 20 comprises an elastic layer 22 on the carrier 21. Grinding means 23 are being integrated within the elastic layer 22. The grinding means 23 are as far as possible evenly distributed within the elastic layer 22. The enlargement of a section of the elastic layer 22 shows the grinding means 23 being arranged therein as grains. For instance corundum grains can be applied, which achieve a particularly good grinding effect. To clean the cylinders these grinding means 23 could also be of a less aggressive type so the cylinder is not being damaged. In place of the grains shown also fibre material can be used as a grinding means 23.

The elastic layer 22 consist of foam material and whereby said foam material gives way under the respective pressure being applied by the clothing or the cylinders to be cleaned. Thereby a compensation of an unevenness in the clothing or on the cylinder could be achieved. Despite said unevenness an excellent grinding effect is being achieved. The elastic layer 22 is preferably laid out in such a way, that the teeth or the wires of the clothing can penetrate the layer 22. This way the teeth or wires of the clothing are also being contacted on their sides by the grinding means 23 and are thus not only treated on their top surface or their points respectively but also on their lateral surfaces. The carding result is thus considerably improved. The elastic layer 22 is mounted in cylindrical form on the carrier 21, so that an even contact and load results on the clothing or on the cylinder to be cleaned.

Figure 3:
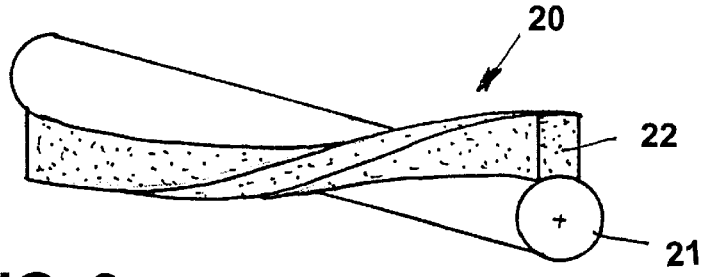

FIG. 3 shows a further embodiment of a grinding part 20. On the carrier 21 an elastic layer 22 is being arranged in spiral-type configuration. This way a certain force balance results during the treatment of a clothing or cylinder, so that an even treatment can take place. This is explained by the fact that the grinding part is not in contact at the same time over the whole axial length with the part to be cleaned or ground. The elastic layer 22 is arranged on an only relatively small section, in circumferential direction of the carrier 21, so that a smooth treatment results.

Figure 4:
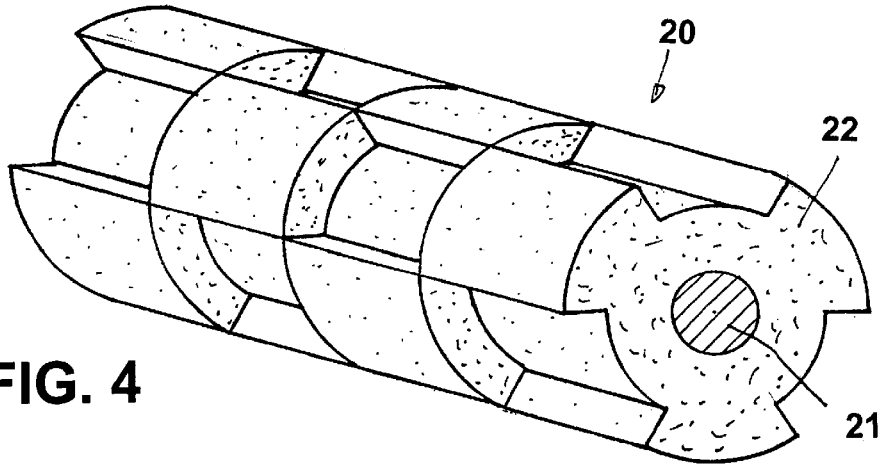

FIG. 4 illustrates a further embodiment of a grinding part 20. The grinding part 20 comprises an elastic layer 22 on its carrier 21, which is being divided into segments.

The single segments are being arranged in chequerboard manner over the circumference of the grinding part 20. Thereby, again a force balance is being achieved during treatment of a clothing or cylinder. Additionally, besides this, a cleaning effect is achieved in the elastic layer 22 by those segments which are being arranged at a lower level, since the particles being torn out from the elastic layer of the higher level segments and the grinding means 23 contained therein, can be removed from the zone of the grinding part 20 or can be suctioned off respectively.

Figure 5:
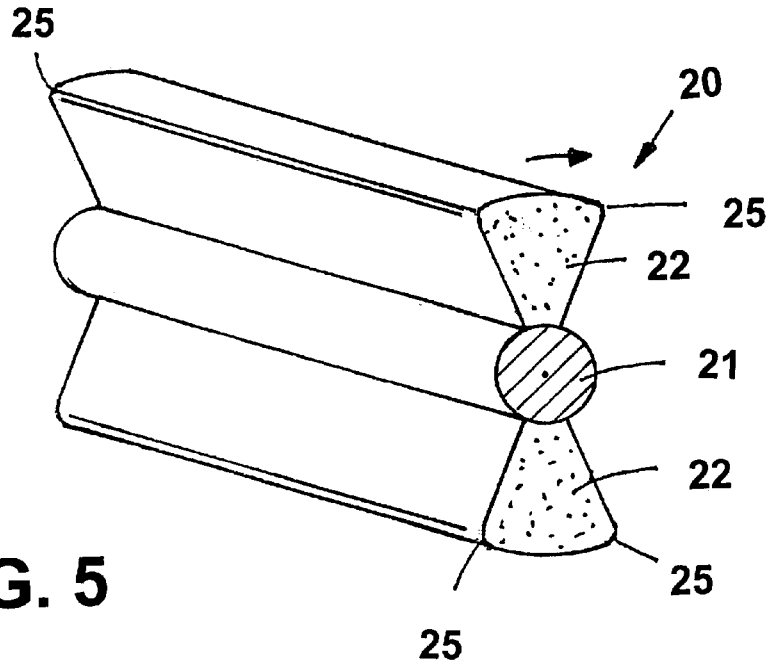

FIG. 5 illustrates still a further embodiment of a grinding part 20. On the carrier 21, two sections with an elastic layer 22 are being arranged. Thereby the elastic layer 22 is being arranged in axial direction of the carrier 21. The single sections of the elastic layer 22 may again be of different height or be furnished with different grinding means 23, so that an individual adaptation onto the element to be ground or cleaned can take place.

The edges of the respective elastic layer 22 are being provided with a chamfer 25. This provides for a better entering of the clothing into the elastic layer 22 and the elastic layer 22 is less exposed to damages. The wear of the elastic layer 22 is thereby reduced. If only one direction of rotation of the grinding part 20 is being specified, then it can be sufficient, if only within the zone where the clothing is entering the elastic layer 22 a chamfer 25 is being furnished. Within the exit zone of the clothing from the elastic layer 22, said chamfer 25 is not necessarily required and can thus be left out accordingly.

Figure 6:
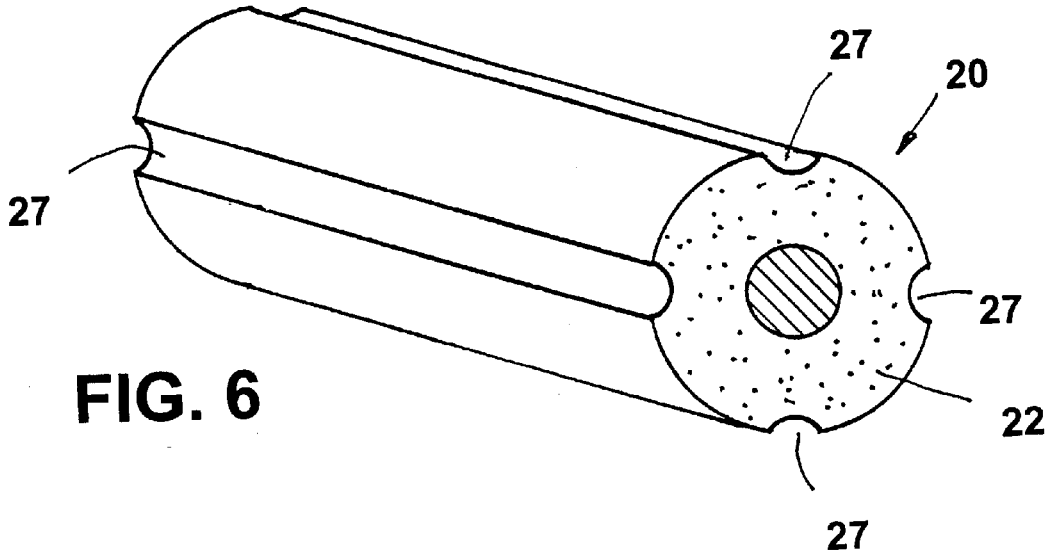

In the exemplified embodiment according to FIG. 6 a grinding part 20 is being shown, which is being provided with an elastic layer 22, which encloses the carrier 21 completely. On the outer circumference of the elastic layer 22 grooves 27 are worked into t he surface. Said groove s 27, amongst other things, serve the purpose to remove the material being torn out from the elastic layer 22 as well as the grinding means 23. Besides the shown axial-parallel arrangement of the grooves 27 said grooves can also be of spiral-type form.

FIGS. 7 and 8 show a grinding part 20', which is not designed as roller. The grinding part 20' shown, is provided as a grindstone, which for instance oscillates over the clothing or the cylinder and thereby effects a grinding or cleaning. The elastic layer 22' which is fastened on the carrier 21' has the same effect as in the embodiment according to the invention with a roller. Here also clothing teeth or wires enter the elastic layer 22' and are being ground or cleaned according to requirements. Depending on the hardness of the elastic material and the quantity of the integrated grinding means, a more or less deep penetration of the clothing takes place, same as it is in the case with rollers. If the length of the grinding part 20' corresponds with the length of the clothing or the cylinder, then the oscillating movement of the grindstone is not required. It is then sufficient if the grinding part 20' is brought into contact with the clothing or the cylinder and thus initiates the grinding or cleaning process respectively.

According to FIG. 8 the carrier 21' is completely surrounded with elastic material 22'. After wear of the elastic layer 22' the grinding part 20' can be turned around its axis by 90° so that a new section of the elastic layer 22' is being made available. Said embodiment can also be used to arrange different grinding means 23 within the elastic layer 22. Depending on the need the grinding part 20' can be turned so that another graining of the grinding means 23 is made available. Each side can accordingly serve for another graining of the grinding means 23', so that in such an embodiment up to 4 different grinding means can be arranged on one carrier 21.

FIG. 9 shows an actually known device to apply a force onto the grinding part 20. By means of a lever the distance of a weight 3 to a fulcrum 31 is changed. Thereby a different pressure force of the grinding part 20 onto the clothing 14 of the flat bar 13 results. The adjustment of the weight 3 or the force exerted by the grinding roller 20 respectively can also take place automatically for instance by means of a hydraulic cylinder. In the most simple embodiment the grinding part 20 with its own weight rests on the clothing 14 and rotates in relation to the clothing 14 by means of a not shown drive. In an alternative form of embodiment the grinding part 20 can also be mounted fixedly within the card frame. The pressure force required for the grinding process of the flat bar 13 is ensured by spring loaded lifting/pressing action of the flat bar onto the grinding part 20. (Analogous to FIG. 7 of DE 199 08708.3).

The device according to the invention can be used for the cleaning of the clothing of the flat bars 13 as well as for grinding of said clothing. Furthermore there is a possibility of application within the zone of the outlet part for the cleaning of the starting rollers or the doffer roller. Accordingly, it is understood that the application of the device according to the invention is also possible on other machines of the textile industry.

The present invention is not limited to the exemplified embodiments. Combinations of the various embodiments are possible as well as other forms and designs of the device according to the invention.

I claim:

1. In a textile machine, a device for grinding clothing teeth and wire, and for cleaning cylinders, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, further comprising a carrier onto which said elastic layer is arranged; and wherein said elastic layer is formed in segments on said carrier.

2. In a textile machine, a device for grinding clothing teeth and wire, and for cleaning cylinders, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, further comprising a carrier onto which said elastic layer is arranged; and wherein said elastic layer is formed with a varying thickness on said carrier.

3. The device as in claim 2, wherein said grinding elements comprise a combination of different materials.

4. The device as in claim 2, wherein said grinding part is configured as a roller, said carrier comprising an axially extending roll and said elastic layer formed around said roll.

5. The device as in claim 2, wherein said grinding part is configured as a grindstone.

6. The device as in claim 2, wherein said elastic layer completely envelopes said carrier.

7. In a textile machine, a device for grinding clothing teeth and wire, and for cleaning cylinders, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, further comprising a carrier onto which said elastic layer is arranged; and wherein said grinding elements comprise a combination of different materials, and wherein coarser said grinding elements are disposed closer to said carrier.

8. In a textile machine, a device for grinding clothing teeth and wire, and for cleaning cylinders, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements; and further comprising means for mounting said grinding part to have an adjustable force against the clothing teeth, wire, or cylinder.

9. The device as in claim 2, wherein said elastic layer is formed of a material such that clothing teeth or wire penetrate into said elastic layer.

10. A textile machine having at least one of clothing teeth, wire, and card cylinder, said machine further comprising a device for grinding said clothing teeth and wire, or for cleaning said cylinder, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, wherein said grinding part further comprises a carrier onto which said elastic layer is arranged; and wherein said elastic layer is formed in segments on said carrier.

11. A textile machine having at least one of clothing teeth, wire, and card cylinder, said machine further comprising a device for grinding said clothing teeth and wire, or for cleaning said cylinder, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, wherein said grinding part further comprises a carrier onto which said elastic layer is arranged; and wherein said elastic layer is formed with a varying thickness on said carrier.

12. The machine as in claim 11, wherein said grinding part is configured as a roller, said carrier comprising an axially extending roll and said elastic layer formed around said roll.

13. The machine as in claim 11, wherein said grinding part is configured as a grindstone.

14. The machine as in claim 11, wherein said elastic layer completely envelopes said carrier.

15. The machine as in claim 11, wherein said grinding elements comprise a combination of different materials.

16. A textile machine having at least one of clothing teeth, wire, and card cylinder, said machine further comprising a device for grinding said clothing teeth and wire, or for cleaning said cylinder, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements, wherein said grinding part further comprises a carrier onto which said elastic layer is arranged; and wherein said grinding elements comprise a combination of different materials, and wherein coarser said grinding elements are disposed closer to said carrier.

17. A textile machine having at least one of clothing teeth, wire, and card cylinder, said machine further comprising a device for grinding said clothing teeth and wire, or for cleaning said cylinder, said device comprising a grinding part having an elastic layer and grinding elements embedded throughout said elastic layer, wherein said elastic layer is formed into a shape for being pressed against the clothing teeth, wire, or cylinder of the intended textile machine, and is formed of a material such that said elastic layer is worn by the clothing teeth, wire, or cylinder thereby exposing underlying embedded said grinding elements; and further comprising means for mounting said grinding part to have an adjustable force against said clothing teeth, wire, or cylinder.

18. The machine as in claim 11, wherein said elastic layer is formed of a material such that said clothing teeth or wire penetrate into said elastic layer.

* * * * *